US009914900B2

(12) United States Patent
Morigaki et al.

(10) Patent No.: US 9,914,900 B2
(45) Date of Patent: Mar. 13, 2018

(54) LIQUID DETERGENT

(71) Applicant: LION CORPORATION, Tokyo (JP)

(72) Inventors: Atsunori Morigaki, Tokyo (JP); Hiroshi Kimura, Tokyo (JP); Hiroshi Konta, Tokyo (JP)

(73) Assignee: Lion Corporation (JP)

( * ) Notice: Subject to any disclaimer, the term of this patent is extended or adjusted under 35 U.S.C. 154(b) by 277 days.

(21) Appl. No.: 14/431,735

(22) PCT Filed: Sep. 27, 2013

(86) PCT No.: PCT/JP2013/076365
§ 371 (c)(1),
(2) Date: Mar. 26, 2015

(87) PCT Pub. No.: WO2014/054541
PCT Pub. Date: Apr. 10, 2014

(65) Prior Publication Data

US 2015/0240188 A1 Aug. 27, 2015

(30) Foreign Application Priority Data

Oct. 1, 2012 (JP) ..... 2012-219894
Feb. 28, 2013 (JP) ..... 2013-039082

(51) Int. Cl.

| | |
|---|---|
| ***C11D 1/12*** | (2006.01) |
| ***C11D 1/22*** | (2006.01) |
| ***C11D 1/29*** | (2006.01) |
| ***C11D 1/37*** | (2006.01) |
| ***C11D 3/30*** | (2006.01) |
| ***C11D 1/16*** | (2006.01) |
| *C11D 1/28* | (2006.01) |

(52) U.S. Cl.
CPC ..... *C11D 1/37* (2013.01); *C11D 1/16* (2013.01); *C11D 3/30* (2013.01); *C11D 1/22* (2013.01); *C11D 1/28* (2013.01); *C11D 1/29* (2013.01)

(58) Field of Classification Search
CPC .. C11D 1/12; C11D 1/143; C11D 1/22; C11D 1/29; C11D 1/37; C11D 3/30
See application file for complete search history.

(56) References Cited

FOREIGN PATENT DOCUMENTS

| | | | | |
|---|---|---|---|---|
| CN | 1247559 | A | 3/2000 | |
| CN | 1282576 | A | 2/2001 | |
| CN | 1407078 | A | 4/2003 | |
| CN | 1533426 | A | 9/2004 | |
| CN | 1282576 | A | 2/2011 | |
| CN | 102575195 | A | 7/2012 | |
| EP | 2489722 | A1 | 8/2012 | |
| GB | 2351979 | A | 1/2001 | |
| JP | 02-132200 | A | 5/1990 | |
| JP | 10-175942 | A | 6/1998 | |
| JP | 2002-146399 | A | 5/2002 | |
| JP | 2002-173698 | A | 6/2002 | |
| JP | 2004-210812 | A | 7/2004 | |
| JP | 2004-231671 | A | 8/2004 | |
| JP | 2007-161805 | A | 6/2007 | |
| JP | 2012-007155 | A | 1/2012 | |
| WO | 9828392 | A1 | 7/1998 | |
| WO | 03008525 | A1 | 1/2003 | |
| WO | 2010/073855 | A1 | 7/2010 | |
| WO | 2011037219 | A1 | 3/2011 | |
| WO | 2011143602 | A1 | 11/2011 | |
| WO | WO 2011/143602 | * | 11/2011 | ..... C11D 3/00 |

OTHER PUBLICATIONS

European Patent Office, "Extended European Search Report" in connection with related European Patent Application No. 13843547.4, dated Sep. 2, 2016, 9 pages.
Japanese Patent Office, "International Search Report" in connection with related PCT Patent Application Serial No. PCT/JP2013/076365, dated Dec. 10, 2013, 7 pages.
State Intellectual Property Office of the People's Republic of China, "First Office Action" in connection with related Chinese Patent App. No. 201380051167A, dated Oct. 26, 2016, 21 pages.
Furuzuma, Taiichi, Examiner, Japanese Patent Office, "Notice of Allowance" in connection with related Japanese Patent App. No. 2014-539709, dated Nov. 7, 2017, 6 pages.

* cited by examiner

*Primary Examiner* — Brian P Mruk
(74) *Attorney, Agent, or Firm* — Kolisch Hartwell, P.C.

(57) ABSTRACT

This liquid detergent contains an α-sulfofatty acid ester salt (component (a)), an alkylbenzene sulfonate (component (b)), a polyoxyethylene alkyl ether sulfate (component (c)), and an alkanolamine (component (d)). The amount of the component (a) is 5% by mass or greater; the total amount of the component (b) and the component (c) is 5% by mass or greater; the total amount of the component (a), the component (b), and the component (c) is 10% by mass to 50% by mass, the mass ratio represented by (d)/(a) is 1/5 or greater, and the mass ratio represented by (a)/((b)+(c)) is 1 or less.

11 Claims, No Drawings

LIQUID DETERGENT

TECHNICAL FIELD

The present invention relates to a liquid detergent.

Priority is claimed on Japanese Patent Application No. 2012-219894, filed Oct. 1, 2012 and Japanese Patent Application No. 2013-039082, filed Feb. 28, 2013, the contents of which are incorporated herein by reference.

BACKGROUND ART

An α-sulfofatty acid ester salt (hereinafter, sometimes referred to as "α-SF salt") which is an anionic surfactant has high detergency and favorable biodegradability, and is used as a cleaning component for various detergents.

For example, a liquid detergent containing an α-SF salt, soap, and an ethylene oxide adduct of a higher fatty alcohol has been proposed (refer to PTL 1).

CITATION LIST

Patent Literature

PTL 1—Japanese Unexamined Patent Application, First Publication No. H2-132200.

SUMMARY OF INVENTION

Technical Problem

A liquid detergent is required to have excellent detergency and liquid stability at low temperatures for use in low temperature regions. In particular, in a detergent using an α-SF salt produced from a fatty acid ester having 16 to 18 carbon atoms, cloudiness or a reduction of fluidity occurs at a low temperature.

The present invention has been made in consideration of the above-described circumstances, and provides a liquid detergent with improved low temperature stability containing an α-SF salt. In particular, in a liquid detergent containing an anionic surfactant which is a cleaning component, as a main component, a liquid detergent in which the problem (cloudiness or a reduction of fluidity at a low temperature) of low-temperature stability in the case of containing the α-SF salt is improved is provided.

Solution to Problem (1) According to a first aspect of the present invention, there is provided a liquid detergent which contains an α-sulfofatty acid ester salt (component (a)), an alkylbenzene sulfonate (component (b)), a polyoxyethylene alkyl ether sulfate (component (c)), and an alkanolamine (component (d)), in which the amount of the component (a) is 5% by mass or greater; the total amount of the components (b) and (c) is 5% by mass or greater; the total amount of the components (a), (b), and (c) is 10% by mass to 50% by mass, the mass ratio represented by (d)/(a) is 1/5 or greater, and the mass ratio represented by (a)/((b)+(c)) is 1 or less.

(2) In the liquid detergent according to (1), the total amount of surfactants is preferably 50% by mass or less.

(3) In the liquid detergent according to (1) or (2), the mass ratio represented by (b)/(c) is preferably 1 or greater.

(4) In the liquid detergent according to any one of (1) to (3), the pH at 25° C. is preferably 5 to 9.

(5) According to a second aspect of the present invention, there is provided a liquid detergent which is formed by mixing at least one type of anionic surfactant (Sa) selected from the group consisting of a sulfonic acid type anionic surfactant and a sulfuric acid ester type anionic surfactant, an alkanolamine, an aromatic sulfonic acid, and water, in which the anionic surfactant (Sa) includes an α-sulfofatty acid ester salt, the mixing amount of the anionic surfactant (Sa) is 10% by mass to 50% by mass, the mixing ratio (molar ratio) of the aromatic sulfonic acid to the alkanolamine (aromatic sulfonic acid/alkanolamine) is 1/2 to 2/1, and the pH at 25° C. is 5 to 9.

(6) In the liquid detergent according to (5), the mixing ratio (molar ratio) of the alkanolamine to the α-sulfofatty acid ester salt (alkanolamine/α-sulfofatty acid ester salt) is preferably 1/5 to 3.5/1.

(7) In the liquid detergent according to (5) or (6), the mixing amount of the α-sulfofatty acid ester salt is preferably 3% by mass or greater.

(8) In the liquid detergent according to any one of (5) to (7), the mixed α-sulfofatty acid ester salt is preferably an alkali metal salt.

(9) In the liquid detergent according to any one of (5) to (8), the alkanolamine is preferably monoethanolamine.

(10) In the liquid detergent according to any one of (5) to (9), the aromatic sulfonic acid is preferably at least one type selected from the group consisting of xylenesulfonic acid, ethylbenzene sulfonic acid, and cumenesulfonic acid.

(11) According to a third aspect of the present invention, there is provided a liquid detergent which contains 10% by mass to 50% by mass of at least one type of anionic surfactant (Sa') selected from the group consisting of a sulfonic acid type anionic surfactant and a sulfuric acid ester type anionic surfactant, an alkali metal salt of an aromatic sulfonic acid and an alkanolamine salt of an aromatic sulfonic acid, an alkanolamine, and water, in which the anionic surfactant (Sa') includes an alkali metal salt of an α-sulfofatty acid ester and an alkanolamine salt of an α-sulfofatty acid ester (C), the molar ratio (A)/(B) of the total of the alkali metal salt of an aromatic sulfonic acid and the alkanolamine salt of an aromatic sulfonic acid (A) to the total of the alkanolamine and the alkanolamine salt (B) is 1/2 to 2/1, and the pH at 25° C. is 5 to 9.

(12) In the liquid detergent according to (11), the molar ratio (B)/(C) of the total of the alkanolamine and the alkanolamine salt (B) to the total of the alkali metal salt of an α-sulfofatty acid ester and the alkanolamine salt of an α-sulfofatty acid ester (C) is preferably 1/5 to 3.5/1.

(13) In the liquid detergent according to (11) or (12), 3% by mass or greater of the alkali metal salt of an α-sulfofatty acid ester and the alkanolamine salt of an α-sulfofatty acid ester (C) is more preferably contained therein.

(14) In the liquid detergent according to any one of (11) to (13), the alkanolamine salt of an aromatic sulfonic acid is preferably a monoethanolamine salt, and the alkanolamine salt of an α-sulfofatty acid ester is preferably a monoethanolamine salt.

(15) In the liquid detergent according to any one of (11) to (14), the aromatic sulfonic acid is preferably at least one type selected from the group consisting of xylenesulfonic acid, ethylbenzene sulfonic acid, and cumenesulfonic acid.

(16) According to a fourth aspect of the present invention, there is provided a method for producing a liquid detergent containing 10% by mass to 50% by mass of at least one type of anionic surfactant selected from the group consisting of a sulfonic acid type anionic surfactant and a sulfuric acid ester type anionic surfactant, an aromatic sulfonic acid, an alkanolamine, and water, and having a pH of 5 to 9 at 25° C., which includes Step (I) of preparing an aqueous solution (X) having a pH of 5 to 9 at 25° C. by adding the aromatic sulfonic acid to an aqueous solution of the alkanolamine and Step (II) of adding at least one type of the anionic surfactant (Sa) selected from the group consisting of a sulfonic acid type anionic surfactant and a sulfuric acid ester type anionic surfactant to the aqueous solution (X) prepared in Step (I), in which the mixing ratio (molar ratio) of the aromatic sulfonic acid to the alkanolamine (aromatic sulfonic acid/alkanolamine) is 1/2 to 2/1, and the anionic surfactant (Sa) includes an α-sulfofatty acid ester salt.

(17) In the method for producing a liquid detergent according to (16), the mixing ratio (molar ratio) of the alkanolamine to the α-sulfofatty acid ester salt (alkanolamine/α-sulfofatty acid ester salt) is preferably 1/5 to 3.5/1.

(18) In the method for producing a liquid detergent according to (16) or (17), the mixing amount of the α-sulfofatty acid ester salt is preferably 3% by mass or greater.

(19) In the method for producing a liquid detergent according to any one of (16) to (18), the alkanolamine is preferably monoethanolamine.

(20) In the method for producing a liquid detergent according to any one of (16) to (19), the aromatic sulfonic acid is preferably at least one type selected from the group consisting of xylenesulfonic acid, ethylbenzene sulfonic acid, and cumenesulfonic acid.

Advantageous Effects of Invention

According to the present invention, there is provided a liquid detergent with improved low temperature stability containing an α-SF salt.

DESCRIPTION OF EMBODIMENTS

Liquid Detergent According to First Aspect

The liquid detergent according to a first aspect of the present invention contains an α-sulfofatty acid ester salt (component (a)), an alkylbenzene sulfonate (component (b)), a polyoxyethylene alkyl ether sulfate (component (c)), and an alkanolamine (component (d)). According to the liquid detergent of the first aspect, it is possible to ensure storage stability under low temperature conditions (around 0° C. to room temperature).

Component (a): α-Sulfofatty Acid Ester Salt

As the α-sulfofatty acid ester salt (α-SF salt, component (a)), an α-sulfofatty acid ester salt obtained by a known production method, for example, an α-sulfofatty acid ester salt obtained by a method in which using a tank reactor equipped with a stirrer in a usual manner, an α-sulfofatty acid ester (α-SF acid) is prepared by sulfonation caused by bring a fatty acid ester which is a raw material into contact with sulfuric anhydride, and then, the α-SF acid is neutralized with sodium hydroxide, can be used. Moreover, before and after the neutralization, bleaching may be performed with hydrogen peroxide or the like.

As the component (a), the compound represented by the following General Formula (a1) is preferably exemplified.

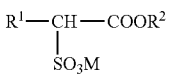

(a1)

where in the formula, $R^1$ represents a hydrocarbon group having 8 to 18 carbon atoms, $R^2$ represents a hydrocarbon group having 1 to 6 carbon atoms, and M is a counter ion.

In Formula (a1), the hydrocarbon group of $R^1$ may have a linear chain form or a branched chain form, or may include a cyclic structure. Among these, the hydrocarbon group of $R^1$ is preferably an aliphatic hydrocarbon group, more preferably a linear or a branched alkyl group or a linear or a branched alkenyl group, and still more preferably a linear alkyl group or a linear alkenyl group. The number of carbon atoms of $R^1$ is 8 to 18, preferably 10 to 18, more preferably 10 to 16, and still more preferably 14 to 16. When the number of carbon atoms of $R^1$ is 8 or greater, detergency is improved. In contrast, when the number of carbon atoms of $R^1$ is 18 or less, liquid stability is improved, and in particular, gelation or deposition at the time of low temperature storage is suppressed.

In Formula (a1), the hydrocarbon group of $R^2$ may have a linear chain form or a branched chain form, or may include a cyclic structure. Among these, the hydrocarbon group of $R^2$ is preferably an aliphatic hydrocarbon group, more preferably a linear or a branched alkyl group or a linear or a branched alkenyl group, and still more preferably a linear alkyl group or a linear alkenyl group. The number of carbon atoms of $R^2$ is 1 to 6, and is preferably 1 to 3. Specific examples of the hydrocarbon group of $R^2$ include a methyl group, an ethyl group, an n-propyl group, and an isopropyl group, and from the viewpoint of further improving the detergency, a methyl group, an ethyl group, and an n-propyl group are preferable, and a methyl group are particularly preferable.

In Formula (a1), M is a counter ion, and may be a counter ion capable of form a water-soluble salt together with $R^1CH(COOR^2)SO_3$—. Examples of the counter ion include an alkali metal ion, a protonated amine, and ammonium. Examples of the alkali metal capable of becoming the counter ion include sodium and potassium. The amine capable of becoming the counter ion may be any one of a primary, a secondary, and a tertiary amine, and the total number of carbon atoms thereof is preferably 1 to 6. The amine may have a hydroxy group, and from the viewpoint of increasing the solubility with respect to water of the liquid detergent under low temperature conditions, the amine preferably has a hydroxy group. Examples of the amine include an alkanolamine, and the number of carbon atoms of the alkanol group is preferably 1 to 3. Specific examples of the alkanolamine include monoethanolamine, diethanolamine, and triethanolamine, and preferably monoethanolamine.

As M, an alkali metal ion is preferable, a sodium ion or a potassium ion is more preferable, and a sodium ion is particularly preferable from the viewpoint of easy availability and further exhibiting a low temperature stability-improving effect of the liquid detergent.

The component (a) may be used alone or two or more types may be used in proper combination. Among the components (a), a compound in which $R^1$ in Formula (a1) is a linear or a branched alkyl group or a linear or a branched alkenyl group having 12 to 18 carbon atoms, and $R^2$ is a methyl group is particularly preferable. In addition, from the viewpoint of increase in the detergency and solubility, as the component (a), a mixed material obtained by mixing materials in which the numbers of carbon atoms of a fatty acid residue (which refers to an acyl group portion) are different is preferably used. Specifically, a mixed material obtained by mixing an α-SF salt (C16) in which $R^1$ in Formula (a1) is a hydrocarbon group having 14 carbon atoms and an α-SF salt (C18) in which $R^1$ is a hydrocarbon group having 16 carbon atoms is preferably used. The mixing ratio (mass ratio) of C16 and C18 is preferably 45:55 to 95:5 (C16:C18), more preferably 60:40 to 90:10, and still more preferably 80:20 to 85:15. When the mass ratio is within a suitable range, the detergency, solubility, and the liquid stability become more favorable.

The amount of the component (a) in the liquid detergent is 5% by mass or greater, and preferably, the amount can be suitably selected within 5% by mass to 25% by mass according to the purpose. From the viewpoint of further exhibiting the effect of the present invention of improving the liquid stability (low temperature stability) at the time of using the component (a) in the liquid detergent, the amount of the component (a) is preferably 7% by mass or greater, and more preferably 10% by mass or greater. In addition, from the viewpoint of being capable of obtaining a liquid detergent having higher liquid stability (low temperature stability), the amount of the component (a) is preferably 20% by mass or less, and more preferably 15% by mass or less. Moreover, in the present specification, the mass of the component (a) is a value in terms of a sodium salt.

Component (b): Alkylbenzene Sulfonate

In the alkylbenzene sulfonate (component (b)), the hydrocarbon group which is bonded to a benzene ring may have a linear chain form or a branched chain form, or may include a cyclic structure. Among these, the hydrocarbon group which is bonded to a benzene ring is preferably an aliphatic hydrocarbon group, more preferably a linear or a branched alkyl group or a linear or a branched alkenyl group, and still more preferably a linear alkyl group or a linear alkenyl group.

The number of carbon atoms of the hydrocarbon group which is bonded to a benzene ring is preferably 8 to 18, more preferably 10 to 18, and still more preferably 12 to 16. When the number of carbon atoms is 8 or greater, the detergency is improved. In contrast, when the number of carbon atoms is 18 or less, foaming increases. In addition, the liquid stability is improved.

Examples of the form of salt include an alkali metal salt, an alkaline earth metal salt, an ammonium salt, and an alkanolamine salt. Examples of the alkali metal salt include a sodium salt and a potassium salt. Examples of the alkaline earth metal salt include a calcium salt and a magnesium salt. Examples of the alkanolamine salt include a monoethanolamine salt, a diethanolamine salt, and a triethanolamine salt.

Component (c): Polyoxyethylene Alkyl Ether Sulfate

As the polyoxyethylene alkyl ether sulfate (component (c)), an alkyl ether sulfate having a linear or branched alkyl group having 10 to 20 carbon atoms, to which an average of 0.5 moles to 10 moles of any of alkylene oxide having 2 to 4 carbon atoms or ethylene oxide (EO) and propylene oxide (PO) (EO/PO=0.1/9.9 to 9.9/0.1 in a molar ratio) were added is preferable.

Examples of the form of salt include an alkali metal salt, an alkaline earth metal salt, an ammonium salt, and an alkanolamine salt. Examples of the alkali metal salt include a sodium salt and a potassium salt. Examples of the alkaline earth metal salt include a calcium salt and a magnesium salt. Examples of the alkanolamine salt include a monoethanolamine salt, a diethanolamine salt, and a triethanolamine salt.

The liquid detergent according to the first aspect includes both the components (b) and (c). The components (b) and (c) contributes to improvement of the liquid stability at a low temperature at the time of using the component (a) in the liquid detergent. By including both of the components (b) and (c), the liquid stability at a lower temperature is improved.

The total amount of the components (b) and (c) in the liquid detergent is 5% by mass or greater, preferably 7% by mass or greater, and more preferably 10% by mass or greater.

The total amount of the components (a), (b), and (c) in the liquid detergent is 10% by mass to 50% by mass. The total amount is preferably 15% by mass or greater, and more preferably 20% by mass or greater. On the other hand, the total amount is preferably 35% by mass or less, and more preferably 25% by mass or less. When the total amount is the above lower limit value or greater, the detergency can be maintained. On the other hand, when the total amount is the above upper limit value or less, a composition having more favorable low temperature stability is obtained.

In the liquid detergent according to the first aspect, the mass ratio represented by (a)/((b)+(c)) (hereinafter, referred to as "(a)/((b)+(c)) mass ratio") is 1 or less. From the viewpoint of excellent liquid stability at a lower temperature, the (a)/((b)+(c)) mass ratio is preferably 0.7 or less, and more preferably 0.5 or less, and the lower limit value is preferably 0.25 or greater.

Moreover, in the present specification, the masses of the components (b) and (c) are values in terms of a sodium salt.

"The mass ratio represented by (a)/((b)+(c))" means the ratio (on the basis of mass) of the content of the component (a) to the total amount of the components (b) and (c) in the liquid detergent.

In the liquid detergent according to the first aspect, the mass ratio represented by (b)/(c) (hereinafter, referred to as "(b)/(c) mass ratio") is preferably 1 or greater, more preferably greater than 1, still more preferably 1.5 or greater, and particularly preferably 2 or greater. In addition, the mass ratio represented by (b)/(c) is preferably 30 or less, and more preferably 15 or less, and still more preferably 10 or less. When the (b)/(c) mass ratio is 1 or greater, foaming increases, and creak of a washing object is less likely to occur. When the (b)/(c) mass ratio is greater than 1, a sufficient amount of foam is generated, and when the (b)/(c) mass ratio is 30 or less, a suitably creamy foam is obtained.

"The mass ratio represented by (b)/(c)" means the ratio (on the basis of mass) of the amount of the component (b) to the amount of the component (c) in the liquid detergent.

Component (d): Alkanolamine

Examples of the alkanolamine (component (d)) include alkanolamines such as monoethanolamine, diethanolamine, and triethanolamine. The component (d) may be used alone or two or more types may be used in combination. The component (d) is preferably monoethanolamine from the viewpoint of excellent liquid stability at a lower temperature.

Moreover, the alkanolamine which is the component (d) in the liquid detergent is also present as a salt or a counter ion of an anionic surfactant. The component (d) contributes to the liquid stability of the liquid detergent at a low temperature by becoming a salt by neutralization with an acid in the liquid detergent or by mixing counter anions of an anionic surfactant such as the components (a), (b), or (c).

In the liquid detergent according to the first aspect, the mass ratio represented by (d)/(a) (hereinafter, referred to as "(d)/(a) mass ratio") is 1/5 or greater, and preferably 3/5 or greater. Within the preferable range, the liquid stability at a lower temperature is excellent.

Moreover, the alkanolamine which is present as a salt or a counter ion of an anionic surfactant is also counted in the mass of the component (d) in the liquid detergent.

"The mass ratio represented by (d)/(a)" means the ratio (on the basis of mass) of the amount of the component (d) to the amount of the component (a) and in the liquid detergent.

Other Components

The liquid detergent according to the first aspect may contain other components in addition to the components (a) to (d), as necessary, within a range which does not impair the effects of the present invention. As other components, which are not particularly limited, components commonly used in liquid detergents such as a liquid detergent for clothing can be used, and the following components are exemplary examples.

The liquid detergent of the aspect preferably also contains a nonionic surfactant (hereinafter, referred to as "component (e)"). By further containing the component (e), the detergency is further increased, and the liquid stability at a low temperature is further improved.

The component (e) is not particularly limited as long as it is used in detergents for clothing in the related art, and examples thereof include a polyoxyalkylene alkyl ether and a polyoxyalkylene alkenyl ether; a polyoxyethylene alkyl phenyl ether and a polyoxyethylene alkenyl phenyl ether; a fatty acid alkyl ester alkoxylate obtained by adding an alkylene oxide to the ester bond (between a carbonyl group and an oxygen atom) of a long chain fatty acid alkyl ester; and a polyoxyethylene sorbitan fatty acid ester, a polyoxyethylene sorbitol fatty acid ester, a polyoxyethylene fatty acid ester, a polyoxyethylene hydrogenated castor oil, a glycerin fatty acid ester, a fatty acid alkanolamide, a polyoxyethylene alkylamine, and an alkylglycoside.

Among the components (e), polyoxyalkylene alkyl ether or a polyoxyalkylene alkenyl ether is preferable from the viewpoint of the detergency and the liquid stability. Specifically, a polyoxyalkylene alkyl ether or a polyoxyalkylene alkenyl ether obtained by adding an average of 3 moles to 30 moles, preferably 4 moles to 20 moles, or more preferably 5 moles to 17 moles of an alkylene oxide having 2 to 4 carbon atoms to an fatty acid alcohol having 10 to 18 carbon atoms, or preferably 12 to 14 carbon atoms is preferable. Among these, a polyoxyethylene alkyl ether, a polyoxyethylene alkenyl ether, a polyoxypropylene alkyl ether, or polyoxypropylene alkenyl ether is preferable. Examples of the aliphatic alcohol used here include a primary alcohol and a secondary alcohol. In addition, the hydrocarbon group in the aliphatic alcohol may have a branched chain. As the aliphatic alcohol, a primary alcohol is preferable.

In addition, the component (e) preferably has a melting point of 50° C. or lower, and more preferably has a melting point of 40° C. or lower. The melting point here is a value measured according to the test methods for melting point described in RS K0064-1992 "Test methods for melting point and melting range of chemical products". In addition, the component (e) preferably has a HLB of 7 to 16, and more preferably has a HLB of 8 to 14. The HLB here is a value determined by the Griffin method (Yoshida et al., "Surfactant Handbook, new edition", Industrial Tosho Co., Ltd., 1991, p. 234).

The component (e) may be used alone or two or more types may be used in proper combination.

The liquid detergent of the aspect may also contain an anionic surfactant or an amphoteric surfactant other than the components (a), (b), and (c) of soap or the like within a range which does not impair the effects of the present invention.

In a case where the liquid detergent of the aspect arbitrarily contains other surfactants such as a nonionic surfactant in addition to the components (a), (b), and (c), the total amount of surfactants in the liquid detergent is preferably 50% by mass or less, more preferably 35% by mass or less, and still more preferably 25% by mass or less.

In addition, the total amount of the components (a), (b), and (c) is preferably 50% by mass or greater, more preferably 70% by mass or greater, and still more preferably 85% by mass or greater with respect to the total amount of the surfactants.

The liquid detergent of the aspect may further contain a builder, a solvent (water, water-miscible organic solvent, or the like), a cationic compound, a preservative, a fluorescent whitening agent, an antisoil redeposition agent, a foam controlling agent, a viscosity-reducing agent or a solubilizing agent, an enzyme, or a thickener as other components.

As the builder, an inorganic builder or an organic builder used in detergents for clothing in the related art can be used.

Examples of the inorganic builder include amorphous aluminosilicate; phosphates such as orthophosphate, pyrophosphate, tripolyphosphate, metaphosphate, hexametaphosphate, and phytate; and a complex of crystalline silicate or carbonate with amorphous alkali metal silicate. Among the inorganic builders, tripolyphosphate is preferable. Examples of the form of salt include an alkali metal salt, an alkaline earth metal salt, an ammonium salt, and an alkanolamine salt.

Examples of the organic builder include formate; aminocarboxylates such as nitrilotriacetate, ethylenediaminetetraacetate, β-alaninediacetate, aspartic acid diacetate, methylglycinediacetate, and iminodisuccinate; hydroxyaminocarboxylates such as serinediacetate, hydroxyiminodisuccinate, hydroxyethylethylenediaminetriacetate, and dihydroxyethylglycine salt; hydroxycarboxylates such as hydroxyacetate, tartrate, citrate, and gluconate; cyclocarboxylate such as pyromellitate, benzopolycarboxylate and cyclopentanetetracarboxylate; ether carboxylate such as carboxymethyltartronate, carboxymethyloxysuccinate, oxydisuccinate, and tartaric acid mono or disuccinate; a copolymer of polyacrylic acid or acrylic acid and an allylalcohol, a copolymer of acrylic acid and maleic acid, a hydroxyacrylic acid polymer, a tetramethylene 1,2-dicarboxylic acid polymer, an aspartic acid polymer, a glutamic acid polymer, such as salts thereof, and organic carboxylic acid polymers thereof Among the organic builders, formate, hydroxycarboxylate, or an organic carboxylic acid polymer is preferable. Both an acid type organic builder and a base type organic builder may be present in the liquid detergent. The builder may be used alone or two or more types may be used in proper combination.

As the builder, one or more types selected from the group consisting of formate, hydroxy carboxylate, an organic carboxylic acid polymer, and inorganic builders are preferably used, and among these, one or more types selected from the group consisting of formate, citrate, a copolymer of acrylic acid and maleic acid and a salt thereof, and tripolyphosphate are more preferably used, from the viewpoint of increase in solubility and ease of formulation of the liquid detergent. Among these, in particular, an organic builder is preferable, formate or hydroxycarboxylate is more preferable, formate or citrate is still more preferable, and formate and citrate are particularly preferably used in combination.

In the liquid detergent, in a case where an inorganic builder is used as a builder, the content of the inorganic builder is preferably 1% by mass to 20% by mass, and more preferably 2% by mass to 16% by mass with respect to the total mass of the liquid detergent; in a case where an organic builder is used, the amount of the organic builder is preferably 0.1% by mass to 10% by mass, and more preferably 0.1% by mass to 7% by mass with respect to the total mass of the liquid detergent; and in a case where an inorganic builder and an organic builder are used in combination, the amount of these builders is preferably 0.1% by mass to 25% by mass, more preferably 3% by mass to 25% by mass, and still more preferably 5% by mass to 20% by mass with respect to the total mass of the liquid detergent.

When the amount of the builder is the lower limit value or greater of the above preferable values, the detergency is increased. On the other hand, when the amount of the builder is the upper limit value or less of the above preferable values, the liquid stability is easily achieved.

The liquid detergent of the aspect preferably contains water as a solvent from the viewpoint of easy production of the liquid detergent and solubility in water when used. The amount of the water in the liquid detergent is preferably 20% by mass to 80% by mass, and more preferably 40% by mass to 75% by mass with respect to the total mass of the liquid detergent. When the amount of the water is the lower limit value or greater of the above preferable values, the liquid stability over time of the liquid detergent become more favorable, and when the amount of the water is the upper limit value or less of the above preferable values, the liquid viscosity becomes suitably low, and thus, from the viewpoint of usability, the amount is favorable.

As the solvent, water-miscible organic solvents other than water may also be used.

The water-miscible organic solvent may be a water-miscible organic solvent which becomes a homogeneous solution when mixed with water, and examples thereof include alcohols such as ethanol, 1-propanol, 2-propanol, and 1-butanol; glycols such as propylene glycol, butylene glycol, and hexylene glycol; polyglycols such as diethylene glycol, triethylene glycol, tetraethylene glycol, polyethylene glycol having an average molecular weight of about 200 to 1000, and dipropylene glycol; and alkyl ethers such as diethylene glycol monomethyl ether, diethylene glycol dimethyl ether, and diethylene glycol monobutyl ether (butyl carbitol). The amount of the water-miscible organic solvent in the liquid detergent is preferably 0.1% by mass to 15% by mass with respect to the total mass of the liquid detergent.

As the cationic surfactant, a cationic surfactant capable of exerting a sterilizing effect and a flexibility imparting effect can be exemplified, and examples thereof include an alkyltrimethyl ammonium salt, a dialkyldimethyl ammonium salt, an alkylbenzyldimethyl ammonium salt, an alkylpyridinium salt, and an amidoamine salt.

As the preservative, Kathon CG (product name) manufactured by Rohm and Haas Co. or PROXEL can be used. The amount of the preservative in the liquid detergent is preferably 0.001% by mass to 1% by mass with respect to the total mass of the liquid detergent.

The liquid detergent of the aspect may contain a fluorescent whitening agent of a distyrylbiphenyl type or the like for the purpose of improving whiteness of white clothing. The amount of the fluorescent whitening agent in the liquid detergent is 0% by mass to 1% by mass with respect to the total mass of the liquid detergent.

The liquid detergent of the aspect may contain a migration proofing agent or antisoil redeposition agent (soil release polymer) such as polyvinylpyrrolidone, carboxymethyl cellulose, and a water-soluble polymer (for example, product name "TexCare SRN-300" manufactured by Clariant Japan KK) having an alkyleneterephthalate unit and/or an alkyleneisophthalate unit and an oxyalkylene unit and/or a polyoxyalkylene unit, for the purpose of preventing soil redeposition. The amount of the antisoil redeposition agent in the liquid detergent is 0% by mass to 2% by mass with respect to the total mass of the liquid detergent.

Examples of the foam controlling agent include defoaming agents such as a silicone emulsifier and a fatty acid; and foam increasing agents such as a medium chain (which has a hydrocarbon group having 12 to 14 carbon atoms) alcohol and a amine oxide. In particular, in a case where a fatty acid is used, the effect in which yellowing can be prevented even if a washing object is washed with water including a large amount of iron ions is obtained. Examples of the fatty acid include lauric acid, myristic acid, palmitic acid, palmitoleic acid, stearic acid, and oleic acid. Among these, myristic acid, palmitic acid, palmitoleic acid, stearic acid, or oleic acid is preferable, and palmitic acid or oleic acid is particularly preferable. The fatty acid may be used alone or two or more types may be used in combination. The fatty acid may be mixed as a salt (surfactant) such as an alkali metal salt or an amine salt. The amount of the fatty acid is the amount when the mass ratio represented by surfactant/fatty acid in the liquid detergent is within 100 to 1000, and preferably within 500 to 800. When the mass ratio is less than 100, the detergency is decreased. On the other hand, when the mass ratio is greater than 1000, a sufficient prevention effect for yellowing is not obtained. In addition, the amount of the fatty acid is preferably 0.01% by mass to 0.2% by mass, and more preferably 0.01% by mass to 0.1% by mass with respect to the total mass of the liquid detergent.

The viscosity-reducing agent or the solubilizing agent is suitably used for suppressing formation of a film by gelation of the liquid detergent on the liquid surface of the liquid detergent, and examples thereof include aromatic sulfonic acid and a salt thereof Specific examples thereof include toluenesulfonic acid, xylenesulfonic acid, cumenesulfonic acid, substituted or unsubstituted naphthalenesulfonic acid, toluenesulfonate, xylenesulfonate, cumenesulfonate, a substituted or unsubstituted naphthalenesulfonate, or salts thereof Examples of the form of salt include a sodium salt, a potassium salt, a calcium salt, a magnesium salt, an ammonium salt, and an alkanolamine salt. The viscosity-reducing agent or the solubilizing agent may be used alone or two or more types may be used in combination. The amount of the viscosity-reducing agent or the solubilizing agent in the liquid detergent is 0.01% by mass to 15% by mass with respect to the total mass of the liquid detergent. When the amount is within the range, the effect of suppressing film formation on the liquid surface of the liquid detergent can be improved.

Examples of the enzyme include protease, amylase, lipase, cellulase, and mannanase.

In addition, the liquid detergent of the aspect may further contain a fragrance, a coloring agent, an emulsifier, or extract such as natural product extract for the purpose of improving the value added of a product.

A representative example of the fragrance is perfume compositions A to D described in Tables 11 to 18 of Japanese Unexamined Patent Application, First Publication No. 2002-146399. The amount of the fragrance in the liquid detergent is 0.1% by mass to 1% by mass with respect to the total mass of the liquid detergent.

Examples of the coloring agent include general-purpose colorants or pigments such as Acid Red 138 (Red 138), Polar Red RLS, Acid Yellow 203, Acid Blue 9, Blue No. 1, Blue No. 205, Green No. 3, Green 201, and Turquoise P-GR (all are product names). The amount of the coloring agent in the liquid detergent is about 0.00005% by mass to 0.005% by mass with respect to the total mass of the liquid detergent. Examples of the emulsifier include a polystyrene emulsion (PS emulsion) and a polyvinylacetate emulsion, and an emulsion having a solid content of 30% by mass to 50% by mass is usually suitably used. Specific examples thereof include polystyrene emulsion (manufactured by Saiden Chemical Industry Co., Ltd., product name: Saivinol RPX-196 PE-3, solid content of 40% by mass). The content of the emulsifier in the liquid detergent is 0.01% by mass to 0.5% by mass with respect to the total mass of the liquid detergent.

Examples of the extract include plant extracts such as maackia amurensis, uva-ursi, echinacea, scutellaria baicalensis, Amur cork tree, coptis, allspice, oregano, sophora, chamomile, honeysuckle, clava, schizonepeta tenuifolia, cinnamomum cassia, bay, magnolia, burdock, comfrey, jashou, burnet, peony, ginger, goldenrod, sambucus nigra, sage, mistletoe, atractylodes lancea, thyme, anemarrhena asphodeloides, clove, satsuma mandarin, tea tree, barberry, houttuynia, nandina domestica, frankincense, angelica dahurica, aglaophenia whiteleggei, saposhnikovia divaricata, psoralea corylifolia L., humulus lupulus, rosewood, mountain grape, millettia sp., lemon balm, blackberry lily, mosla japonica, eucalyptus, lavender, rose, rosemary, balun, cedar, abies balsamea, dictamnus, summer cypress, polygonum aviculare, gentiana macrophylla root, liquidambar, adenophora triphylla, yamabishi, cayratia japonica, licorice, and hypericum perforatum. The content of the extract in the liquid detergent is preferably about 0% by mass to 0.5% by mass with respect to the total mass of the liquid detergent.

In the liquid detergent of the aspect, a pH adjusting agent may be used to adjust the pH of the liquid detergent to a desired value. Here, in a case where by adding only respective components described above, the pH of the liquid detergent becomes the desired pH, a pH adjusting agent may not be used. Examples of the pH adjusting agent include acidic compounds such as sulfuric acid and hydrochloric acid; and alkaline compounds such as sodium hydroxide and potassium hydroxide. As the alkaline compound, amines other than the component (d) can also be used. These pH adjusting agents may be used alone or two or more types may be used in combination.

The pH of the liquid detergent according to the first aspect at 25° C. is preferably 5 to 9, and more preferably 7 to 9. When the pH of the liquid detergent is within the above preferable range, in the case of storing the liquid detergent for a long period of time, stabilization of the α-SF salt is further improved and thus, favorable detergency is likely to be maintained.

In the present invention, the pH of the liquid detergent at 25° C. is a value measured by using a pH meter (product name: HM-30G, manufactured by DKK-TOA CORPORATION) or the like.

The liquid detergent of the aspect can be produced by a common method, and for example, the liquid detergent can be produced by mixing the respective components described above.

Liquid Detergent According to Second Aspect

The liquid detergent according to a second aspect of the present invention is formed by mixing at least one type of anionic surfactant (Sa) selected from the group consisting of a sulfonic acid type anionic surfactant and a sulfuric acid ester type anionic surfactant, an alkanolamine, an aromatic sulfonic acid, and water. According to the liquid detergent of the second aspect, it is possible to ensure storage stability under lower temperature conditions (around −20° C. to room temperature).

Anionic Surfactant (Sa)

The anionic surfactant (Sa) is at least one type selected from the group consisting of a sulfonic acid type anionic surfactant and a sulfuric acid ester type anionic surfactant, and includes an α-sulfofatty acid ester salt.

As the α-sulfofatty acid ester salt, the same as the above-described α-sulfofatty acid ester salt (component (a)) can be mixed in. Among these, as the α-sulfofatty acid ester salt mixed in, an alkali metal salt is preferable from the viewpoint of more easily obtaining the low temperature stability-improving effect of the liquid detergent and easy availability.

In the liquid detergent according to the second aspect, the mixing amount of the α-sulfofatty acid ester salt is preferably 3% by mass or greater, and can be suitably selected according to the purpose. From the viewpoint of further exhibiting the effect of the present invention of improving the liquid stability (low temperature stability) at the time of using the α-sulfofatty acid ester salt in the liquid detergent, the mixing amount of the α-sulfofatty acid ester salt is preferably 5% by mass or greater, more preferably 7% by mass or greater, and still more preferably 10% by mass or greater. In addition, from the viewpoint of being capable of obtaining a liquid detergent having higher liquid stability (low temperature stability), the amount of the α-sulfofatty acid ester salt is preferably 20% by mass or less, and more preferably 15% by mass or less.

Examples of the anionic surfactant (Sa) other than the α-sulfofatty acid ester salt include anionic surfactants shown below, that is, a linear or branched alkylbenzene sulfonate (LAS or ABS) having an alkyl group having 8 to 18 carbon atoms, an alkane sulfonate having 10 to 20 carbon atoms, an α-olefin sulfonate (AOS) having 10 to 20 carbon atoms, an alkyl sulfate or an alkenyl sulfate (AS) having 10 to 20 carbon atoms, an alkyl (or alkenyl) ether sulfate (AES) having a linear or branched alkyl (or alkenyl) group having 10 to 20 carbon atoms, to which an average of 0.5 moles to 10 moles of any of alkylene oxide having 2 to 4 carbon atoms or ethylene oxide and propylene oxide (EO/PO=0.1/9.9 to 9.9/0.1 in a molar ratio) were added; an alkyl (or alkenyl) phenyl ether sulfate having a linear or branched alkyl (or alkenyl) group having 10 to 20 carbon atoms, to which an average of 3 moles to 30 moles of any of alkylene oxide having 2 to 4 carbon atoms or ethylene oxide and propylene oxide (EO/PO=0.1/9.9 to 9.9/0.1 in a molar ratio) were added; and a salt of alkylpolyhydric alcohol ether sulfuric acid such as an alkylglyceryl ether sulfonic acid having 10 to 20 carbon atoms.

These anionic surfactants can be used alone or two or more types can be used in proper combination.

Moreover, the anionic surfactant (Sa) is not limited to the anionic surfactants exemplified above, and other known sulfonic acid type anionic surfactants or sulfuric acid ester type anionic surfactants can be suitably used, and these can be used alone or two or more types can be used in proper combination.

As the sulfonic acid type anionic surfactant other than the α-sulfofatty acid ester salt, an alkylbenzene sulfonate can be preferably used, and as the sulfuric acid ester type anionic surfactant, a polyoxyethylene alkyl ether sulfate can be preferably used.

As the alkylbenzene sulfonate, the same as the above-described alkylbenzene sulfonate (component (b)) can be used.

As the polyoxyethylene alkyl ether sulfate, the same as the above-described polyoxyethylene alkyl ether sulfate (component (c)) can be used.

In the liquid detergent according to the second aspect, the α-sulfofatty acid ester salt is necessarily mixed, and an anionic surfactant selected from the group consisting of other sulfonic acid type anionic surfactants and sulfuric acid ester type anionic surfactants is preferably used in combination with the α-sulfofatty acid ester salt. The sulfonic acid type anionic surfactant and the sulfuric acid ester type anionic surfactant other than the α-sulfofatty acid ester salt contributes to improvement of the liquid stability at a low temperature at the time of mixing the α-sulfofatty acid ester salt with the liquid detergent. Among these, from the viewpoint of improving the liquid stability at a lower temperature, an alkylbenzene sulfonate or a polyoxyethylene alkyl ether sulfate is preferable, and the alkylbenzene sulfonate or the polyoxyethylene alkyl ether sulfate are preferably used in combination.

The total mixing amount of the sulfonic acid type anionic surfactant and the sulfuric acid ester type anionic surfactant other than the α-sulfofatty acid ester salt in the liquid detergent is preferably 5% by mass or greater, more preferably 7% by mass or greater, and still more preferably 10% by mass or greater.

The total mixing amount of the anionic surfactant (Sa) (at least one type (includes the α-sulfofatty acid ester salt) selected from the group consisting of a sulfonic acid type anionic surfactant and a sulfuric acid ester type anionic surfactant) in the liquid detergent is 10% by mass to 50% by mass. The total mixing amount is preferably 15% by mass or greater, and more preferably 20% by mass or greater. On the other hand, the total mixing amount is preferably 35% by mass or less, and more preferably 25% by mass or less. When the mixing amount is the above lower limit value or greater, the detergency can be maintained. On the other hand, when the mixing amount is the above upper limit value or less, a composition having more favorable low temperature stability is obtained.

Alkanolamine

Examples of the alkanolamine include alkanolamines such as monoethanolamine, diethanolamine, and triethanolamine. The alkanolamine may be used alone or two or more types may be used in combination. The alkanolamine is preferably monoethanolamine from the viewpoint of excellent liquid stability at a lower temperature.

Moreover, the alkanolamine contributes to the liquid stability of liquid detergent at a low temperature by interaction with the aromatic sulfonic acid which was separately mixed and the α-sulfofatty acid ester salts. The action mechanism is not clear, however, it is considered that this is because the alkanolamine in the liquid detergent forms a salt with an aromatic sulfonic acid or is present as a counter ion of the anionic surfactant, and due to this, a composition stable even at a low temperature is formed.

In the liquid detergent according to the second aspect, the mixing ratio (molar ratio) of the alkanolamine to the α-sulfofatty acid ester salt (alkanolamine/α-sulfofatty acid ester salt) is preferably 1/5 to 3.5/1. The lower limit of the above-described molar ratio is preferably 1/1 or greater, and more preferably 3/2 or greater. The upper limit of the above-described molar ratio is preferably 3/1 or less, and more preferably 2.5/1 or less. When the molar ratio is within a range of the lower limit to the upper limit, the effect of the present invention is further exhibited. In particular, when the alkanolamine is excessive, the excessive alkanolamine forms a salt with an aromatic sulfonic acid or an acid for pH adjustment, thus, a large amount of salt formed is present in the composition, and due to this, the liquid stability at a low temperature is impaired in some cases. In particular, in a case where toluene sulfonic acid is used as an aromatic sulfonic acid, the above-described molar ratio is preferably 2.2 or less, and more preferably 2 or less.

Aromatic Sulfonic Acid

Examples of the aromatic sulfonic acid include aromatic sulfonic acids such as toluenesulfonic acid, xylenesulfonic acid, ethylbenzenesulfonic acid, and cumenesulfonic acid. The aromatic sulfonic acid may be used alone or two or more types may be used in combination. Among these, the aromatic sulfonic acid is preferably at least one type selected from the group consisting of xylenesulfonic acid, ethylbenzenesulfonic acid, and cumenesulfonic acid, and more preferably cumenesulfonic acid from the viewpoint of excellent liquid stability at a lower temperature.

In the liquid detergent according to the second aspect, the mixing ratio (molar ratio) of an aromatic sulfonic acid to an alkanolamine (aromatic sulfonic acid/alkanolamine) is 1/2 to 2/1, and the upper limit of the molar ratio is preferably 4/3 or less, and more preferably 1.1/1 or less.

When the molar ratio is within the above range, storage stability under lower temperature conditions is easily ensured, and the liquid stability such as freeze-restoration is also improved.

Water

The liquid detergent according to the second aspect contains water as a solvent from the viewpoint of easy production of the liquid detergent and solubility in water when used. The amount of the water in the liquid detergent is preferably 20% by mass to 80% by mass, and more preferably 40% by mass to 75% by mass with respect to the total mass of the liquid detergent. When the amount of the water is the preferable lower limit value or greater, the liquid stability of the liquid detergent over time become more favorable, and when the amount of the water is the preferable upper limit value or less, the liquid viscosity becomes suitably low, and thus, from the viewpoint of usability, the amount is favorable.

Other Components

Other components may be mixed in the liquid detergent according to the second aspect in addition to the above-described components, as necessary, within a range which does not impair the effects of the present invention. As other components, which are not particularly limited, components commonly used in liquid detergents such as a liquid detergent for clothing can be mixed in, and specifically, the following components are exemplary examples.

The liquid detergent of the aspect preferably also contains a nonionic surfactant. By further containing a nonionic surfactant, the detergency is further increased, and the liquid stability at a low temperature is further improved.

As the nonionic surfactant, the same as the above-described nonionic surfactant (component (e)) can be added and mixed therewith.

The liquid detergent of the aspect may also contain an anionic surfactant or an amphoteric surfactant other than the anionic surfactant (Sa) of soap or the like within a range which does not impair the effects of the present invention.

In a case where other surfactants such as a nonionic surfactant are arbitrarily mixed in the liquid detergent of the aspect in addition to the anionic surfactant (Sa), the total amount of surfactants in the liquid detergent is preferably 50% by mass or less, more preferably 35% by mass or less, and still more preferably 25% by mass or less.

In addition, the total amount of the anionic surfactant (Sa) is preferably 50% by mass or greater, more preferably 70% by mass or greater, and still more preferably 85% by mass or greater with respect to the total amount of the surfactants.

A builder, a water-miscible organic solvent, a cationic compound, a preservative, a fluorescent whitening agent, an antisoil redeposition agent, a foam controlling agent, a viscosity-reducing agent or a solubilizing agent, an enzyme, a fragrance, a coloring agent, an emulsifier, extracts, a pH adjusting agent, or a thickener may be further mixed in the liquid detergent of the aspect as other components.

As other components exemplified here, the same as the above-described builder, water-miscible organic solvent, cationic compound, preservative, fluorescent whitening agent, antisoil redeposition agent, foam controlling agent, viscosity-reducing agent or solubilizing agent, enzyme, fragrance, coloring agent, emulsifier, extracts, pH adjusting agent, or thickener can be mixed in, respectively.

The pH of the liquid detergent according to the second aspect at 25° C. is preferably 5 to 9, and more preferably 7 to 9. When the pH of the liquid detergent is within the above range, in the case of storing the liquid detergent for a long period of time, stabilization of the α-SF salt is further improved and thus, favorable detergency is likely to be maintained. In addition, when the pH is the upper limit value or less, the effect of the liquid stability at a low temperature is more favorably exhibited, and thus it is preferable. When the pH is greater than the upper limit value, the liquid becomes clouded at a low temperature, and thus, the liquid stability is decreased in some cases.

Liquid Detergent According to Third Aspect

The liquid detergent according to a third aspect of the present invention contains 10% by mass to 50% by mass of at least one type of anionic surfactant (Sa') selected from the group consisting of a sulfonic acid type anionic surfactant and a sulfuric acid ester type anionic surfactant, an alkali metal salt of an aromatic sulfonic acid and an alkanolamine salt of an aromatic sulfonic acid, an alkanolamine, and water. According to the liquid detergent of the third aspect, it is possible to ensure storage stability under lower temperature conditions (around −20° C. to room temperature).

The anionic surfactant (Sa') is at least one type selected from the group consisting of a sulfonic acid type anionic surfactant and a sulfuric acid ester type anionic surfactant, and includes an alkali metal salt of the α-sulfofatty acid ester and an alkanolamine salt of the α-sulfofatty acid ester (C) (hereinafter, referred to as "component (C)").

As the component (C), a compound in which M is an alkali metal ion or M is a protonated alkanolamine in General Formula (al) is preferable.

In the liquid detergent according to the third aspect, the amount of the component (C) is preferably 3% by mass or greater. From the viewpoint of further exhibiting the effect of the present invention of improving the liquid stability (low temperature stability) at the time of using the α-sulfofatty acid ester salt in the liquid detergent, the amount of the component (C) is preferably 5% by mass or greater, more preferably 7% by mass or greater, and still more preferably 10% by mass or greater. In addition, from the viewpoint of being capable of obtaining a liquid detergent having higher liquid stability (low temperature stability), the amount of the component (C) is preferably 20% by mass or less, and more preferably 15% by mass or less.

Examples of the anionic surfactant (Sa') (a sulfonic acid type anionic surfactant and a sulfuric acid ester type anionic surfactant) other than the component (C) include the same surfactants as those exemplified as the anionic surfactant (Sa) described above.

The liquid detergent according to the third aspect contains the component (C) (an alkali metal salt of the α-sulfofatty acid ester and an alkanolamine salt of the α-sulfofatty acid ester), and preferably also contains an anionic surfactant selected from the group consisting of other sulfonic acid type anionic surfactants and sulfuric acid ester type anionic surfactants with the component (C).

The sulfonic acid type anionic surfactant and the sulfuric acid ester type anionic surfactant other than the component (C) contributes to improvement of the liquid stability at a low temperature at the time of mixing the α-sulfofatty acid ester salt with the liquid detergent. Among these, from the viewpoint of improving the liquid stability at a lower temperature, an alkylbenzene sulfonate or a polyoxyethylene alkyl ether sulfate is preferable, and the alkylbenzene sulfonate and the polyoxyethylene alkyl ether sulfate are preferably contained in combination.

As the alkylbenzene sulfonate, the same as the above-described alkylbenzene sulfonate (component (b)) can be used.

As the polyoxyethylene alkyl ether sulfate, the same as the above-described polyoxyethylene alkyl ether sulfate (component (c)) can be used.

The total amount of the sulfonic acid type anionic surfactant and the sulfuric acid ester type anionic surfactant other than the α-sulfofatty acid ester salt in the liquid detergent is preferably 5% by mass or greater, more preferably 7% by mass or greater, and still more preferably 10% by mass or greater.

The total amount of the anionic surfactant (Sa') (at least one type (includes the component (C)) selected from the group consisting of a sulfonic acid type anionic surfactant and a sulfuric acid ester type anionic surfactant) in the liquid detergent is 10% by mass to 50% by mass. The total amount is preferably 15% by mass or greater, and more preferably 20% by mass or greater. On the other hand, the total amount is preferably 35% by mass or less, and more preferably 25% by mass or less. When the total amount is the above lower limit value or greater, the detergency can be maintained. On the other hand, when the total amount is the above upper limit value or less, a composition having more favorable low temperature stability is obtained.

The liquid detergent according to the third aspect can be prepared, for example, by a method in which using an aromatic sulfonic acid and an alkanolamine, an alkanolamine salt of the aromatic sulfonic acid is formed, and then, this alkanolamine salt and an alkali metal salt of an α-sulfofatty acid ester are counter ion-exchanged in an aqueous solvent. In the liquid detergent, an alkali metal salt of an α-sulfofatty acid ester, an alkanolamine salt of an α-sulfofatty acid ester, an alkali metal salt of an aromatic sulfonic acid, an alkanolamine salt of the aromatic sulfonic acid, or an alkanolamine which does not become a counter ion can be present.

As the aromatic sulfonic acid, the same aromatic sulfonic acids as those in Aromatic Sulfonic Acid described above can be used, and among these, at least one type selected from the group consisting of xylenesulfonic acid, ethylbenzenesulfonic acid, and cumenesulfonic acid is preferable, and cumenesulfonic acid is particularly preferable from the viewpoint of excellent liquid stability at a lower temperature.

As the alkanolamine, the same alkanolamines as those in Alkanolamine described above can be used, and among these, monoethanolamine is preferable from the viewpoint of excellent liquid stability at a lower temperature. That is, the alkanolamine salt of an aromatic sulfonic acid which is present in the liquid detergent is preferably a monoethanolamine salt, and the alkanolamine salt of an α-sulfofatty acid ester is preferably a monoethanolamine salt.

In the liquid detergent according to the third aspect, the molar ratio (A)/(B) of the total of the alkali metal salt of an aromatic sulfonic acid and the alkanolamine salt of an aromatic sulfonic acid (A) to the total of the alkanolamine and the alkanolamine salt (B) is 1/2 to 2/1, and the upper limit of the molar ratio is preferably 4/3 or less, and more preferably 1.1/1 or less.

The "total of (A)" is a total amount of the alkali metal salt of an aromatic sulfonic acid and the alkanolamine salt of an aromatic sulfonic acid which are present in the liquid detergent.

The "total of (B)" is a total amount of a free alkanolamine and an alkanolamine (alkanolamine salt) obtained by protonation, comprising counter ions of an α-sulfofatty acid ester, and a sulfonic acid type anionic surfactant, other than the α-sulfofatty acid ester, and a sulfuric acid ester type anionic surfactant which are present in the liquid detergent.

In the liquid detergent according to the third aspect, the molar ratio (B)/(C) of the total of the alkanolamine and the alkanolamine salt (B) to the total of the alkali metal salt of an α-sulfofatty acid ester and the alkanolamine salt of an α-sulfofatty acid ester (C) is preferably 1/5 to 3.5/1. The lower limit of the above-described molar ratio is more preferably 1/1 or greater, and still more preferably 3/2 or greater. The upper limit of the above-described molar ratio is preferably 3/1 or less, and more preferably 2.5/1 or less. When the molar ratio is within a range of the lower limit to the upper limit, the effect of the present invention is further exhibited. In particular, when the alkanolamine is excessive, the excessive free alkanolamine forms a salt with an aromatic sulfonic acid or an acid for pH adjustment, thus, a large amount of salt formed is present in the composition, and due to this, the liquid stability at a low temperature is impaired in some cases. In particular, in a case where toluene sulfonic acid is used as an aromatic sulfonic acid, the above-described molar ratio is preferably 2.2 or less, and more preferably 2 or less.

The "total of (C)" is a total amount of the alkali metal salt of an α-sulfofatty acid ester and the alkanolamine salt of an α-sulfofatty acid ester which are present in the liquid detergent.

In addition, when the liquid detergent according to the third aspect is prepared by a method other than the methods described above, an alkanolamine salt of an α-sulfofatty acid ester or an alkanolamine salt of an aromatic sulfonic acid may be used as a raw material.

Other components may be mixed in the liquid detergent according to the third aspect in addition to the above-described components, as necessary, within a range which does not impair the effects of the present invention. As other components, which are not particularly limited, components commonly used in liquid detergents such as a liquid detergent for clothing can be mixed in, and specifically, the above-described components are exemplary examples.

The pH of the liquid detergent according to the third aspect at 25° C. is preferably 5 to 9, and more preferably 7 to 9. When the pH of the liquid detergent is within the above range, in the case of storing the liquid detergent for a long period of time, stabilization of the α-SF salt is further improved and thus, favorable detergency is likely to be maintained. In addition, when the pH is the upper limit value or less, the effect of the liquid stability at a low temperature is favorably exhibited, and thus it is preferable. When the pH is greater than the upper limit value, the liquid becomes clouded at a low temperature, and thus, the liquid stability is decreased in some cases.

Method for Producing Liquid Detergent According to Fourth Aspect

A method for producing a liquid detergent according to a fourth aspect of the present invention is a method for producing a liquid detergent containing 10% by mass to 50% by mass of at least one type of anionic surfactant selected from the group consisting of a sulfonic acid type anionic surfactant and a sulfuric acid ester type anionic surfactant, an aromatic sulfonic acid, an alkanolamine, and water, and having a pH of 5 to 9 at 25° C., which includes Step (I) of preparing an aqueous solution (X) having a pH of 5 to 9 at 25° C. by adding the aromatic sulfonic acid to an aqueous solution of the alkanolamine and Step (II) of adding at least one type of the anionic surfactant (Sa) selected from the group consisting of a sulfonic acid type anionic surfactant and a sulfuric acid ester type anionic surfactant to the aqueous solution (X) prepared in Step (I).

The method for producing the liquid detergent is a suitable method for producing the liquid detergent according to the second aspect or the third aspect described above.

Examples of at least one type of anionic surfactant selected from the group consisting of a sulfonic acid type anionic surfactant and a sulfuric acid ester type anionic surfactant include the same surfactants as the anionic surfactant (Sa') described above.

As the aromatic sulfonic acid, the same aromatic sulfonic acids as those in Aromatic Sulfonic Acid described above can be used, and among these, at least one type selected from the group consisting of xylenesulfonic acid, ethylbenzenesulfonic acid, and cumenesulfonic acid is preferable, and cumenesulfonic acid is particularly preferable from the viewpoint of excellent liquid stability at a lower temperature.

As the alkanolamine, the same alkanolamines as those in Alkanolamine described above can be used, and among these, monoethanolamine is preferable from the viewpoint of excellent liquid stability at a lower temperature.

Other components other than the above-described components may be mixed in the liquid detergent produced by the production method of the aspect.

In addition, the pH of the liquid detergent produced by the production method of the aspect at 25° C. is preferably 5 to 9, and more preferably 7 to 9.

Step (I)

In Step (I), an aqueous solution (X) having a pH of 5 to 9 at 25° C. is prepared by adding the aromatic sulfonic acid to an aqueous solution of the alkanolamine.

The mixing ratio (molar ratio) of the aromatic sulfonic acid to the alkanolamine (aromatic sulfonic acid/alkanolamine) is 1/2 to 2/1, and the upper limit of the molar ratio is preferably 4/3 or less, and more preferably 1.1/1 or less.

When adjusting the pH of the aqueous solution (X), the above-described pH adjusting agent may be added as necessary.

Step (II)

In Step (II), at least one type of anionic surfactant (Sa) selected from the group consisting of a sulfonic acid type anionic surfactant and a sulfuric acid ester type anionic surfactant and, as necessary, other components are added to the aqueous solution (X) prepared in Step (I) and the resultant product is mixed.

An α-sulfofatty acid ester salt is included in the anionic surfactant (Sa). As the α-sulfofatty acid ester salt, an alkali metal salt is preferably mixed in. The mixing amount of the α-sulfofatty acid ester salt is preferably 3% by mass or greater (the content ratio of the α-sulfofatty acid ester salt in the liquid detergent finally obtained is 3% by mass or greater).

When the anionic surfactant (Sa) is added, the mixing ratio (molar ratio) of an alkanolamine to an α-sulfofatty acid ester salt (alkanolamine/α-sulfofatty acid ester salt) is preferably 1/5 to 3.5/1, and the lower limit of the above-described molar ratio is more preferably 1/1 or greater, and still more preferably 3/2 or greater. The upper limit of the above-described molar ratio is preferably 3/1 or less, and more preferably 2.5/1 or less.

The production method of the aspect may include steps other than Steps (I) and (II).

Finally, by adjusting the water content or adjusting the pH such that the pH at 25° C. becomes 5 to 9, a desired liquid detergent in which the content of at least one type of anionic surfactant selected from the group consisting of the sulfonic acid type anionic surfactant and the sulfuric acid ester type anionic surfactant is 10% by mass to 50% by mass is obtained.

The liquid detergent according to the first, the second, or the third aspect described above can be used by the same methods as ordinary methods for use in a general liquid detergent for clothing Specifically, a method in which a liquid detergent is put into water in a washing machine together with a washing object when washing and then, washing is performed; and a method in which a liquid detergent is applied to a washing object or a washing object is immersed in a diluted solution of the liquid detergent, and after being suitably left to stand, washing is performed by using a washing machine is an exemplary example

EXAMPLES

Hereinafter, the present invention will be described in more detail with reference to Examples and Comparative Examples, but the present invention is not limited to the following Examples. Moreover, "%" in Examples represents "% by mass" unless specified otherwise.

1. Raw Materials Used

The raw materials shown in Table 1 were used.

Moreover, a flaky solid (hereinafter, referred to as "α-SF salt solid") of a sodium salt of α-sulfofatty acid methyl ester was prepared in advance by producing a paste-like concentrate, and cooling and pulverizing this in the following manner.

Production of Paste-Like α-SF-1:

330 kg of a fatty acid methyl ester mixture (a mixture obtained by mixing methyl palmitate and methyl stearate in advance such that the mass ratio of the methyl palmitate (product name Pastel M-16, manufactured by Lion Corporation) and the methyl stearate (product name Pastel M-180, manufactured by Lion Corporation) becomes 8:2) was poured into a reactor having a capacity of 1 kL equipped with a stirrer, and as a coloring inhibitor, 5 parts by mass of anhydrous sodium sulfate with respect to 100 parts by mass of the fatty acid methyl ester mixture was put thereinto while stirring. Next, 115 kg (1.2-fold by mole with respect to the fatty acid methyl ester mixture) of $SO_3$ gas (sulfonation gas) diluted to 4% by volume with nitrogen gas at a reaction temperature of 80° C. while continuously stirring was blown thereinto at a constant speed over 3 hours while bubbling, and then, aging was performed for 30 minutes at a temperature of 80° C.

Next, 14 kg of methanol was supplied thereto as a lower alcohol, and esterification was performed at a temperature of 80° C. for aging time of 30 minutes.

Then, the esterified product withdrawn from the reactor was continuously neutralized by adding an equivalent of an aqueous sodium hydroxide solution using a line mixer.

Then, the neutralized product was poured into a bleaching agent mixing line, then, 1% by mass of 35% by volume hydrogen peroxide water with respect to the anionic surfactant concentration (total concentration of α-sulfofatty acid methyl ester sodium salt (α-SF-Na) and α-sulfofatty acid disodium salt (di-Na salt)) in terms of pure content was supplied and the resultant product was mixed, and bleaching was performed at a temperature of 80° C., whereby a paste-like α-SF-1 was obtained.

Production of Paste-Like α-SF-2:

330 kg of a fatty acid methyl ester mixture (a mixture obtained by mixing methyl palmitate and methyl stearate in advance such that the mass ratio of the methyl palmitate (product name Pastel M-16, manufactured by Lion Corporation) and the methyl stearate (product name Pastel M-180, manufactured by Lion Corporation) becomes 6:4) was poured into a reactor having a capacity of 1 kL equipped with a stirrer, and, as a coloring inhibitor, 5 parts by mass of anhydrous sodium sulfate with respect to 100 parts by mass of the fatty acid methyl ester mixture was put thereinto while stirring. Next, 113 kg (1.2-fold by mole with respect to the fatty acid methyl ester mixture) of $SO_3$ gas (sulfonation gas) diluted to 4% by volume with nitrogen gas at a reaction temperature of 80° C. while continuously stirring was blown thereinto at a constant speed over 3 hours while bubbling, and then, aging was performed for 30 minutes at a temperature of 80° C.

Next, a paste-like α-SF-2 was obtained in the same manner as in the production of the paste-like α-SF-1.

Condensation of Paste-Like α-SF Salt:

Each of the obtained paste-like α-SF salts (α-SF-1, α-SF-2) was introduced at 35 kg/hr into a vacuum thin film evaporator (heat transfer surface: 0.5 $m^2$, inner diameter of cylindrical treatment portion: 205 mm, clearance between heat transfer surface and blade tip which was scraping means: 3 mm, product name "EXEVA", manufactured by KOBELCO ECO-SOLUTIONS Co., Ltd.) which rotates at a rotation speed of 1060 rpm and at blade tip speed of about 11 m/s, and condensation was performed under the conditions of an inner wall heating temperature (temperature of heat transfer surface) of 135° C. and a degree of vacuum (pressure in treatment portion) of 0.007 MPa to 0.014 MPa. The temperature of the obtained concentrate was 115° C. and the water content was 2.5% by mass.

Production of α-SF Salt Solid:

Each of the obtained concentrates was continuously supplied at 222 kg/h to a double belt-type belt cooler (NR3-Lo. Cooler) manufactured by Nippon Belting Co., Ltd. in which the clearance between input pulleys was adjusted to 2 mm, and then cooled. The belt moving speed at this time was set to 6 m/s, the flow rate of cooling water was set to 1500 L/h on the upper belt side (cooling by flowing down in a counter-current method on the rear surface of a belt) and 1800 L/h on the lower belt side (cooling by spraying to the rear surface of a belt), and the cooling water supply temperature was set to 20° C. Then, the α-SF salt-containing material sheet obtained by being discharged from the cooling belt was pulverized at a rotation speed of 200 rpm using a disintegrator installed in the vicinity of the discharge pulley, whereby each of flaky α-SF salt solids at 25° C. (α-SF-1, α-SF-2) was obtained.

TABLE 1

| | Symbol | Raw material name | Source of supply and the like |
|---|---|---|---|
| Anionic surfactant | α-SF-1 | Sodium salt of α-sulfofatty acid methyl ester (chain length mixing molar ratio: C16/C18 = 85/15) | α-SF salt solid: synthesized product (flake form) |
| | α-SF-2 | Sodium salt of α-sulfofatty acid methyl ester (chain length mixing molar ratio: C16/C18 = 6/4) | α-SF salt solid: synthesized product (flake form) |
| | LAS | Linear alkylbenzenesulfonic acid sodium salt | Neutralization of product name Lion LH-200 manufactured by Lion Corporation with sodium hydroxide |
| | AES | Polyoxyethylene alkyl ether sulfuric acid sodium salt having an alkyl group having 12 to 14 carbon atoms, to which an average of 2 moles of ethylene oxide were added | Product name EMAL 270N manufactured by Kao Corporation |
| Alkanolamine | MEA | Monoethanolamine | Monoethanolamine diluted with water manufactured by NIPPON SHOKUBAI Co., Ltd. (75% by mass) |
| Aromatic sulfonic acid | Cumenesulfonic acid | Taycatox 500 | Manufactured by TAYCA Corporation |
| | Metaxylenesulfonic acid | Taycatox 110 | Manufactured by TAYCA Corporation |
| | Ethylbenzene sulfonic acid | Ethylbenzene sulfonic acid | Manufactured by Sigma-Aldrich Co. LLC. |
| | PTS-H | Taycatox 300 (paratoluenesulfonic acid) | Manufactured by TAYCA Corporation |
| Aliphatic sulfonic acid | Methanesulfonic acid | Methanesulfonic acid | Manufactured by Wako Pure Chemical Industries, Ltd. |
| Preservative | Kathon | Kathon CG | Manufactured by Rohm and Haas Co. |
| | PROXEL | PROXEL IB | Manufactured by Arch Chemicals Japan, Inc. |
| Fluorescent whitening agent | TINOPAL CBS | TINOPAL CBS-X | Manufactured by BASF Corp. |
| Fragrance | Fragrance | — | Perfume composition A described in Tables 11 to 18 of Japanese Unexamined Patent Application, First Publication No. 2002-146399 |
| Enzyme | EVERLASE 16L | EVERLASE 16L TypeEX (protease) | Manufactured by Novozymes |
| pH adjusting agent | Sulfuric acid | Sulfuric acid | Manufactured by Toho Zinc Co., Ltd. (30% by mass) |

C16: α-SF salt in which $R^1$ in Formula (a1) is an alkyl group having 14 carbon atoms
C18: α-SF salt in which $R^1$ in Formula (a1) is an alkyl group having 16 carbon atoms 2. Method for Producing Liquid Detergent—1

The liquid detergents shown in Examples A1 to A12 and Comparative Examples A1 to A6 were prepared in the following manner according to the mixing amount of each composition shown in Tables 2 and 3.

First, a 75% by mass aqueous monoethanolamine solution was diluted with water of 80% of the amount to be used as a balance, and the pH of the resultant product was adjusted to 7.5 by neutralization with 30% by mass sulfuric acid. Subsequently, all of the other components (respective components shown in Tables 2 and 3, and common components described below) were mixed therein, and the resultant product was stirred at about 50° C., whereby a homogeneous solution was obtained. Next, 30% by mass sulfuric acid was added thereto such that the pH became 7.0, and finally, the resultant product was adjusted so as to have a predetermined composition by adding water thereto, whereby liquid detergents were prepared.

In Table, in a case where the column of the mixing component is blank, this means that the mixing component is not mixed in. In Table, the amount of the mixing component is % by mass, and represents the amount in terms of pure content.

3. Method for Producing Liquid Detergent—2

The liquid detergents shown in Examples B1 to B26 and Comparative Examples B1 and B2 were prepared in the following manner according to the mixing amount of each composition shown in Tables 4 and 5.

First, a 75% by mass aqueous monoethanolamine solution was diluted with water of 80% of the amount to be used as a balance, and the pH of the resultant product was adjusted to 9 or less by neutralization with aromatic sulfonic acid or methanesulfonic acid and 30% by mass sulfuric acid. Subsequently, all of the other components (respective components shown in Tables 4 and 5, and common components described below) were mixed therein, and the resultant product was stirred at about 50° C., whereby a homogeneous solution was obtained. Next, 30% by mass sulfuric acid was added thereto such that the pH became 7.0, and finally, the resultant product was adjusted so as to have a predetermined composition by adding water thereto, whereby liquid detergents were prepared.

In Table, in a case where the column of the mixing component is blank, this means that the mixing component is not added. In Table, the amount of the mixing component is % by mass, and represents the amount in terms of pure content.

Common components are as follows. The amount (% by mass) of each of the mixing components represents the ratio of the components in the liquid detergent.

Common components: Caisson 0.1% by mass, PROXEL 0.1% by mass, TINOPAL CBS 0.05% by mass, perfume 0.3% by mass, and EVERLASE 16L 0.1% by mass.

4. Evaluation of Low Temperature Stability of Liquid Detergent

The evaluation of the low temperature stability was performed on the liquid detergent of each Example by the evaluation method described below. The results are shown in Tables 2 to 5.

50 mL of each of the liquid detergents was put into a sample bottle, and the bottles were placed in a thermostat with 5° C., a thermostat with 0° C., and a thermostat with −5° C., respectively. After one month, the appearance was visually observed, and evaluation was performed according to the following evaluation criteria.

A: Liquid detergent was transparent or precipitation of the component did not occur at a temperature of conditions of 5° C., 0° C., and −5° C.

B: Liquid detergent was transparent or precipitation of the component did not occur at a temperature of conditions of both 5° C. and 0° C.

C: Liquid detergent was transparent or precipitation of the component did not occur at a temperature of conditions of 5° C.

D: Liquid detergent was opaque, precipitation of the component occurred, or solidification occurred.

5. Evaluation of Freeze-Restoration of Liquid Detergent 50 mL of each of the liquid detergent was put into a sample bottle, and the bottle was sealed by closing the lid. In this state, a cycle in which the sample bottle containing the liquid detergent was allowed to stand at −20° C. for 12 hours and then, allowed to stand at 0° C. for 12 hours was continuously performed 6 times, and whether or not precipitation or solidification in the liquid detergent in the state of 0° C. of each cycle had occurred was observed.

Then, using the number of continuous cycles at which precipitation or solidification in the liquid detergent in the state of 0° C. was not observed and the liquid stability was secured as an index, the evaluation of freeze-restoration of the liquid detergent was performed. The results (the number of continuous cycles at which the liquid stability was secured) are shown in Tables 4 and 5.

TABLE 2

| | | | Example | | | | | | Comparative Example | | | |
|---|---|---|---|---|---|---|---|---|---|---|---|---|
| | | | A1 | A2 | A3 | A4 | A5 | A6 | A1 | A2 | A3 | A4 |
| Component (% by mass) | (a) | α-SF-1 | 5 | 5 | 7.5 | 7.5 | 10 | 10 | 5 | 7.5 | 7.5 | 7.5 |
| | (b) | LAS | 5 | 7.5 | 2.5 | 5 | 5 | 7.5 | 5 | 2 | 0 | 7.5 |
| | (c) | AES | 5 | 2.5 | 5 | 2.5 | 5 | 2.5 | 5 | 3 | 7.5 | 0 |
| | (d) | MEA | 1 | 1 | 1.5 | 1.5 | 2 | 2 | 0.5 | 1.5 | 1.5 | 1.5 |
| | Other components | | Common component | | | | | | | | | |
| | Water | | Balance | | | | | | | | | |
| Mass ratio and the like | (d)/(a) | | 0.2 | 0.2 | 0.2 | 0.2 | 0.2 | 0.2 | 0.1 | 0.2 | 0.2 | 0.2 |
| | (a)/((b) + (c)) | | 0.5 | 0.5 | 1.0 | 1.0 | 1.0 | 1.0 | 0.5 | 1.5 | 1.0 | 1.0 |
| | (b) + (c) (% by mass) | | 10 | 10 | 7.5 | 7.5 | 10 | 10 | 10 | 5 | 7.5 | 7.5 |
| | (a) + (b) + (c) (% by mass) | | 15 | 15 | 15 | 15 | 20 | 20 | 15 | 12.5 | 15 | 15 |
| | (b)/(c) | | 1.0 | 3.0 | 0.5 | 2.0 | 1.0 | 3.0 | 1.0 | 0.7 | 0 | — |
| Evaluation of low temperature stability | | | C | C | C | C | C | C | D | D | D | D |

TABLE 3

| | | | Example | | | | | | Comparative Example | |
|---|---|---|---|---|---|---|---|---|---|---|
| | | | A7 | A8 | A9 | A10 | A11 | A12 | A5 | A6 |
| Component (% by mass) | (a) | α-SF-2 | 5 | 5 | 7.5 | 7.5 | 10 | 10 | 5 | 7.5 |
| | (b) | LAS | 5 | 7.5 | 2.5 | 5 | 5 | 7.5 | 5 | 2 |
| | (c) | AES | 5 | 2.5 | 5 | 2.5 | 5 | 2.5 | 5 | 3 |
| | (d) | MEA | 1 | 1 | 1.5 | 1.5 | 2 | 2 | 0.5 | 1.5 |
| | Other components | | Common component | | | | | | | |
| | Water | | Balance | | | | | | | |
| Mass ratio and the like | (d)/(a) | | 0.2 | 0.2 | 0.2 | 0.2 | 0.2 | 0.2 | 0.1 | 0.2 |
| | (a)/((b) + (c)) | | 0.5 | 0.5 | 1.0 | 1.0 | 1.0 | 1.0 | 0.5 | 1.5 |
| | (b) + (c) (% by mass) | | 10 | 10 | 7.5 | 7.5 | 10 | 10 | 10 | 5 |
| | (a) + (b) + (c) (% by mass) | | 15 | 15 | 15 | 15 | 20 | 20 | 15 | 12.5 |
| | (b)/(c) | | 1.0 | 3.0 | 0.5 | 2.0 | 1.0 | 3.0 | 1.0 | 0.7 |
| Evaluation of low temperature stability | | | C | C | C | C | C | C | D | D |

TABLE 4

| | | | Example | | | | | | | | | | | | | Comparative Example |
|---|---|---|---|---|---|---|---|---|---|---|---|---|---|---|---|---|
| | | | B1 | B2 | B3 | B4 | B5 | B6 | B7 | B8 | B9 | B10 | B11 | B12 | B13 | B1 |
| Component (% by mass) | Anionic surfactant | α-SF-1 | 5 | 5 | 10 | 10 | 10 | 5 | 5 | 5 | 5 | 5 | 5 | 5 | 5 | 5 |
| | | LAS | 5 | 5 | 5 | 0 | 5 | 5 | 5 | 5 | 5 | 5 | 5 | 5 | 5 | 5 |
| | | AES | 5 | 5 | 0 | 5 | 5 | 5 | 5 | 5 | 5 | 5 | 5 | 5 | 5 | 5 |
| | Alkanol-amine | MEA | 1 | 1 | 2 | 2 | 2 | 1 | 1 | 1 | 1 | 1 | 1 | 1 | 1 | 0 |
| | Aromatic sulfonic acid | Cumene-sulfonic acid | 1 | 2 | 4 | 4 | 4 | 0 | 0 | 0 | 0 | 0 | 3 | 4 | 0 | 1 |

TABLE 4-continued

| | | | Example | | | | | | | | | | | | | Comparative Example |
|---|---|---|---|---|---|---|---|---|---|---|---|---|---|---|---|---|
| | | | B1 | B2 | B3 | B4 | B5 | B6 | B7 | B8 | B9 | B10 | B11 | B12 | B13 | B1 |
| | | Metaxylene-sulfonic acid | 0 | 0 | 0 | 0 | 0 | 2 | 0 | 0 | 0 | 0 | 0 | 0 | 3 | 0 |
| | | Ethylbenzene sulfonic acid | 0 | 0 | 0 | 0 | 0 | 0 | 2 | 0 | 0 | 0 | 0 | 0 | 0 | 0 |
| | | PTS-H | 0 | 0 | 0 | 0 | 0 | 0 | 0 | 2 | 0 | 0 | 0 | 0 | 0 | 0 |
| | Aliphatic sulfonic acid | Methane-sulfonic acid | 0 | 0 | 0 | 0 | 0 | 0 | 0 | 0 | 0 | 2 | 0 | 0 | 0 | 0 |
| | Other components | | Common component | | | | | | | | | | | | | |
| | Water | | Balance | | | | | | | | | | | | | |
| Total amount of anionic surfactant (% by mass) | | | 15 | 15 | 15 | 15 | 20 | 15 | 15 | 15 | 15 | 15 | 15 | 15 | 15 | 15 |
| Aromatic sulfonic acid/alkanolamine (molar ratio) | | | 0.30 | 0.61 | 0.61 | 0.61 | 0.61 | 0.66 | 0.66 | 0.71 | 0 | — | 0.92 | 1.22 | 0.98 | — |
| Evaluation of low temperature stability | | | B | A | A | A | A | A | A | A | C | C | A | A | A | D |
| Evaluation of freeze-restoration (number of cycles) | | | 0 | 6 | 6 | 6 | 6 | 6 | 6 | 0 | 0 | 0 | 6 | 6 | 6 | 0 |

TABLE 5

| | | | Example | | | | | | | | | | | | | Comparative Example |
|---|---|---|---|---|---|---|---|---|---|---|---|---|---|---|---|---|
| | | | B14 | B15 | B16 | B17 | B18 | B19 | B20 | B21 | B22 | B23 | B24 | B25 | B26 | B2 |
| Component (% by mass) | Anionic surfactant | α-SF-2 | 5 | 5 | 10 | 10 | 10 | 5 | 5 | 5 | 5 | 5 | 5 | 5 | 5 | 5 |
| | | LAS | 5 | 5 | 5 | 0 | 5 | 5 | 5 | 5 | 5 | 5 | 5 | 5 | 5 | 5 |
| | | AES | 5 | 5 | 0 | 5 | 5 | 5 | 5 | 5 | 5 | 5 | 5 | 5 | 5 | 5 |
| | Alkanol-amine | MEA | 1 | 1 | 2 | 2 | 2 | 1 | 1 | 1 | 1 | 1 | 1 | 1 | 1 | 0 |
| | Aromatic sulfonic acid | Cumene-sulfonic acid | 1 | 2 | 4 | 4 | 4 | 0 | 0 | 0 | 0 | 0 | 3 | 4 | 0 | 1 |
| | | Metaxylene-sulfonic acid | 0 | 0 | 0 | 0 | 0 | 2 | 0 | 0 | 0 | 0 | 0 | 0 | 3 | 0 |
| | | Ethylbenzene sulfonic acid | 0 | 0 | 0 | 0 | 0 | 0 | 2 | 0 | 0 | 0 | 0 | 0 | 0 | 0 |
| | | PTS-H | 0 | 0 | 0 | 0 | 0 | 0 | 0 | 2 | 0 | 0 | 0 | 0 | 0 | 0 |
| | Aliphatic sulfonic acid | Methane-sulfonic acid | 0 | 0 | 0 | 0 | 0 | 0 | 0 | 0 | 0 | 2 | 0 | 0 | 0 | 0 |
| | Other components | | Common component | | | | | | | | | | | | | |
| | Water | | Balance | | | | | | | | | | | | | |
| Total amount of anionic surfactant (% by mass) | | | 15 | 15 | 15 | 15 | 20 | 15 | 15 | 15 | 15 | 15 | 15 | 15 | 15 | 15 |
| Aromatic sulfonic acid/alkanolamine (molar ratio) | | | 0.30 | 0.61 | 0.61 | 0.61 | 0.61 | 0.66 | 0.66 | 0.71 | 0 | — | 0.92 | 1.22 | 0.98 | — |
| Evaluation of low temperature stability | | | B | A | A | A | A | A | A | A | C | C | A | A | A | D |
| Evaluation of freeze-restoration (number of cycles) | | | 0 | 6 | 6 | 6 | 6 | 6 | 6 | 0 | 0 | 0 | 6 | 6 | 6 | 0 |

INDUSTRIAL APPLICABILITY

The liquid detergent of the present invention can be used as domestic or industrial use, among these, the liquid detergent is suitable for domestic use, and more suitable for a liquid detergent for clothing. As the type of the washing object, washing objects similar to those washed at home are exemplary examples, and examples thereof include fiber products such as clothing, a dish cloth, towels, a sheet, and a curtain.

What is claimed is:

1. A liquid detergent, comprising:

an α-sulfofatty acid ester salt having the following General Formula (a1):

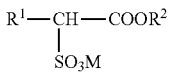

(a1)

wherein $R^1$ is a hydrocarbon group having 14 to 16 carbon atoms, $R^2$ is a hydrocarbon group having 1 to 6 carbon atoms, and M is a counter ion (component (a));

an alkylbenzene sulfonate (component (b));

a polyoxyethylene alkyl ether sulfate (component (c)); and a monoethanolamine (component (d)), wherein an amount of the component (a) is 5% by mass or greater;

a total amount of the components (b) and (c) is 5% by mass or greater;

a total amount of the components (a), (b), and (c) is 10% by mass to 50% by mass, a mass ratio represented by (d)/(a) is 1/5 or greater, and a mass ratio represented by (a)/((b)+(c)) is 1 or less.

2. The liquid detergent according to claim 1, wherein the total amount of surfactants is 50% by mass or less.

3. The liquid detergent according to claim 1, wherein the mass ratio represented by (b)/(c) is 1 or greater.

4. The liquid detergent according to claim 1, wherein the pH at 25°C. is 5 to 9.

5. A liquid detergent which is formed by mixing at least one type of anionic surfactant (Sa) selected from the group consisting of a sulfonic acid type anionic surfactant and a sulfuric acid ester type anionic surfactant, a monoethanolamine, an aromatic sulfonic acid, and water, wherein the anionic surfactant (Sa) includes an α-sulfofatty acid ester salt having the following General Formula (a1):

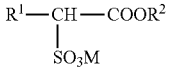

(a1)

wherein $R^1$ is a hydrocarbon group having 14 to 16 carbon atoms, $R^2$ is a hydrocarbon group having 1 to 6 carbon atoms, and M is a counter ion, wherein the aromatic sulfonic acid is at least one type selected from the group consisting of xylenesulfonic acid, ethylbenzene sulfonic acid, and cumenesulfonic acid, a mixing amount of the anionic surfactant (Sa) is 10% by mass to 35% by mass, a mixing ratio (molar ratio) of the aromatic sulfonic acid to the monoethanolamine (aromatic sulfonic acid/monoethanolamine) is 1/2to 2/1, a mixing amount of the α-sulfofatty acid ester salt is 3% by mass to 15% by mass, and a pH of the liquid detergent at 25°C. is 5 to 9.

6. The liquid detergent according to claim 5, wherein the mixing ratio (molar ratio) of the monoethanolamine to the α-sulfofatty acid ester salt (monoethanolamine/α-sulfofatty acid ester salt) is 1/5to 3.5/1.

7. The liquid detergent according to claim 5, wherein the mixing amount of the α-sulfofatty acid ester salt is 3% by mass or greater.

8. The liquid detergent according to claim 5, wherein the mixed α-sulfofatty acid ester salt is an alkali metal salt.

9. A liquid detergent, comprising:

10% by mass to 35% by mass of at least one type of anionic surfactant (Sa') selected from the group consisting of a sulfonic acid type anionic surfactant and a sulfuric acid ester type anionic surfactant;

an alkali metal salt of an aromatic sulfonic acid and a monoethanolamine salt of an aromatic sulfonic acid;

a monoethanolamine; and water, wherein the aromatic sulfonic acid is at least one type selected from the group consisting of xylenesulfonic acid, ethylbenzene sulfonic acid, and cumenesulfonic acid, wherein the anionic surfactant (Sa') includes an alkali metal salt of an α-sulfofatty acid ester having the following General Formula (a1):

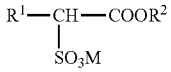

(a1)

wherein $R^1$ is a hydrocarbon group having 14 to 16 carbon atoms, $R^2$ is a hydrocarbon group having 1 to 6 carbon atoms, and M is a counter ion, and the anionic surfactant (Sa') includes a monoethanolamine salt of an α-sulfofatty acid ester having the following General Formula (a1):

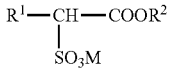

(a1)

wherein $R^1$ is a hydrocarbon group having 14 to 16 carbon atoms, $R^2$ is a hydrocarbon group having 1 to 6 carbon atoms, and M is a counter ion (C), a molar ratio (A)/(B) of a total of the alkali metal salt of an aromatic sulfonic acid and the monoethanolamine salt of an aromatic sulfonic acid (A) to a total of the monoethanolamine and the monoethanolamine salt (B) is 1/2to 2/1, a mixing amount of (C) is 3% by mass to 15% by mass, and a pH of the liquid detergent at 25°C. is 5 to 9.

10. The liquid detergent according to claim 9, wherein the molar ratio (B)/(C) of the total of the monoethanolamine and the monoethanolamine salt (B) to the total of the alkali metal salt of an α-sulfofatty acid ester and the monoethanolamine salt of an α-sulfofatty acid ester (C) is 1/5 to 3.5/1.

11. The liquid detergent according to claim 9, further comprising:

3% by mass or greater of the alkali metal salt of an α-sulfofatty acid ester and the monoethanolamine salt of an α-sulfofatty acid ester (C).

* * * * *